US012214934B2

(12) United States Patent
Guillevic et al.

(10) Patent No.: US 12,214,934 B2
(45) Date of Patent: Feb. 4, 2025

(54) CLOSURE MECHANISM FOR PRODUCT CONTAINER

(71) Applicant: ELC MANAGEMENT LLC, Melville, NY (US)

(72) Inventors: Romain Julien Guillevic, Belz (FR); Marc Emile Lechanoine, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 138 days.

(21) Appl. No.: 17/875,008

(22) Filed: Jul. 27, 2022

(65) Prior Publication Data

US 2024/0034518 A1 Feb. 1, 2024

(51) Int. Cl.

| | |
|---|---|
| ***B65D 41/02*** | (2006.01) |
| ***A45D 40/00*** | (2006.01) |
| ***A45D 40/20*** | (2006.01) |

(52) U.S. Cl.

CPC ..... *B65D 41/02* (2013.01); *A45D 40/20* (2013.01); *A45D 2040/0025* (2013.01); *A45D 2200/05* (2013.01)

(58) Field of Classification Search

CPC ..... A45D 40/06; A45D 40/10; B43K 23/128; B43K 24/026; B43K 24/086; B43K 24/088; B65D 41/02; B65D 41/16; B65D 41/18; B65D 51/18

USPC ..... 401/117

See application file for complete search history.

(56) References Cited

U.S. PATENT DOCUMENTS

| | | | | |
|---|---|---|---|---|
| 7,172,356 | B2 | 2/2007 | Habatjou | |
| 7,429,140 | B2 * | 9/2008 | Demellier | A45D 40/10 401/262 |
| 7,841,794 | B2 * | 11/2010 | Salciarini | A45D 40/10 401/262 |
| 8,287,199 | B2 * | 10/2012 | Salciarini | A45D 34/046 401/109 |
| 9,215,922 | B2 * | 12/2015 | Delage | A45D 40/26 |
| 9,877,566 | B2 | 1/2018 | Liard | |
| 2004/0089318 | A1 | 5/2004 | Tahara | |
| 2016/0157584 | A1 | 6/2016 | Chen | |
| 2018/0368554 | A1 | 12/2018 | Lin | |

OTHER PUBLICATIONS

International Application No. PCT/US2023/028474, International Search Report and Written Opinion, mailed Nov. 21, 2023.

* cited by examiner

*Primary Examiner* — David P Angwin
*Assistant Examiner* — Bradley S Oliver
(74) *Attorney, Agent, or Firm* — MARSHALL, GERSTEIN & BORUN LLP

(57) ABSTRACT

A cosmetic product container may include a cap body having first and second ends and defining a cap cavity, a cap liner operably coupled with the cap body and being movable along a length thereof, a resilient member operably coupled with one of the cap body or the cap liner, and a coupling protrusion operably coupled with the other of the cap line or the cap body. In response to moving the cap body relative to the cap liner in a first direction, the resilient member slidably engages the coupling protrusion and moves to an energized position. Continued movement of the cap body relative to the cap liner causes the resilient member to urge the cap body in the first direction.

9 Claims, 14 Drawing Sheets

CLOSURE MECHANISM FOR PRODUCT CONTAINER

FIELD OF THE DISCLOSURE

The present disclosure generally relates to cosmetic, hair care, body care, and/or skincare products and, more particularly, to container closure mechanisms for such products.

BACKGROUND

Cosmetic, hair care, body care, and/or skincare products may be provided in a number of different containers, and may be applied using a number of varying approaches. In some examples, such containers may include a cap portion and a body portion that operably couple with each other for storage and/or display purposes. Existing systems may use a number of techniques to ensure the two portions remain coupled with each other such as, for example, magnets. While the use of magnets and/or magnetic materials may provide assurance that the package will remain closed, such materials may not be disposed of in a sustainable manner, and in turn may lead to environmental waste. Further, magnets require significant processing and energy to produce, which may run counter to stainability goals due to the creation of environmental waste. While other systems may incorporate friction-fit couplings, threaded couplings, and the like, such systems may not provide ample coupling strength between the container portions, and may result in the product becoming unintentionally opened and/or otherwise damaged.

Accordingly, there is a need for improved systems having improved functionalities.

SUMMARY

Examples within the scope of the present disclosure are directed to closure systems for cosmetic and/or other product containers. Such cosmetic product containers may include a cap body having first and second ends and defining a cap cavity, a cap liner operably coupled with the cap body and being movable along a length thereof, a resilient member operably coupled with one of the cap body or the cap liner, and a coupling protrusion operably coupled with the other of the cap line or the cap body. In response to moving the cap body relative to the cap liner in a first direction, the resilient member slidably engages the coupling protrusion and moves to an energized position. Continued movement of the cap body relative to the cap liner causes the resilient member to urge the cap body in the first direction.

In an approach, the coupling protrusion includes a tapered body having an engagement surface and the resilient member includes a finger adapted to slidably engage the engagement surface of the tapered body. In these and other approaches, the resilient member may include a plurality of arms. Further, in some examples, the tapered body may include a track adapted to slidably engage the resilient member.

In some examples, the cosmetic product may further include a base having a neck adapted to couple with the cap liner. Upon coupling the cap liner with the base and moving the cap body in a direction towards the base, the resilient member moves to the energized position.

In accordance with a second aspect, a container includes a first body having a resilient member operably coupled thereto or formed therewith and a second body having a coupling protrusion operably coupled thereto or formed therewith. The first body extends a longitudinal axis. The second body is adapted to move in a first direction to operably couple with the first body of the first portion. Upon operably coupling the first body with the second body, the resilient member is adapted to engage the coupling protrusion and move in a second direction, the second direction being different than the first direction.

In accordance with a third aspect, a cosmetic product container includes a cap body having a first end and a second end and defining a cap cavity, a second body operably coupled with the cap body and being adapted to operably couple therewith, a resilient member operably coupled with one of the cap body or the second body, and a coupling protrusion operably coupled with the other of the cap body or the second body. The resilient member is movable between an initial position, an energized position, and a de-energized position. The coupling protrusion is adapted to slidably engage the resilient member. Upon operably coupling the cap body with the second body, the coupling protrusion urges the resilient member from the initial position to the energized position. Continued relative movement between the cap body and the second body causes the resilient member to move to the de-energized position whereby the cap body is secured with the second body.

In accordance with a fourth aspect, a cosmetic product container includes a cap body having a first end and a second end and defining a cap cavity, a cap liner operably coupled with the cap body and being movable relative to a length thereof, a resilient member operably coupled with one of the cap body or the cap liner and being movable relative to at least one of the cap body or the cap liner, and a base adapted to operably couple with at least one of the cap body or the cap liner. In response to moving the cap body towards the base in a first direction, the cap liner moves relative to the cap body in a second direction and the resilient member moves relative to at least one of the cap body or the cap liner in a third direction to urge the cap body towards the base.

BRIEF DESCRIPTION OF THE DRAWINGS

The above needs are at least partially met through provision of one, more than one, or any combination of the approaches for closure systems for product containers described in the following detailed description, particularly when studied in conjunction with the drawings, wherein.

Figure 1:
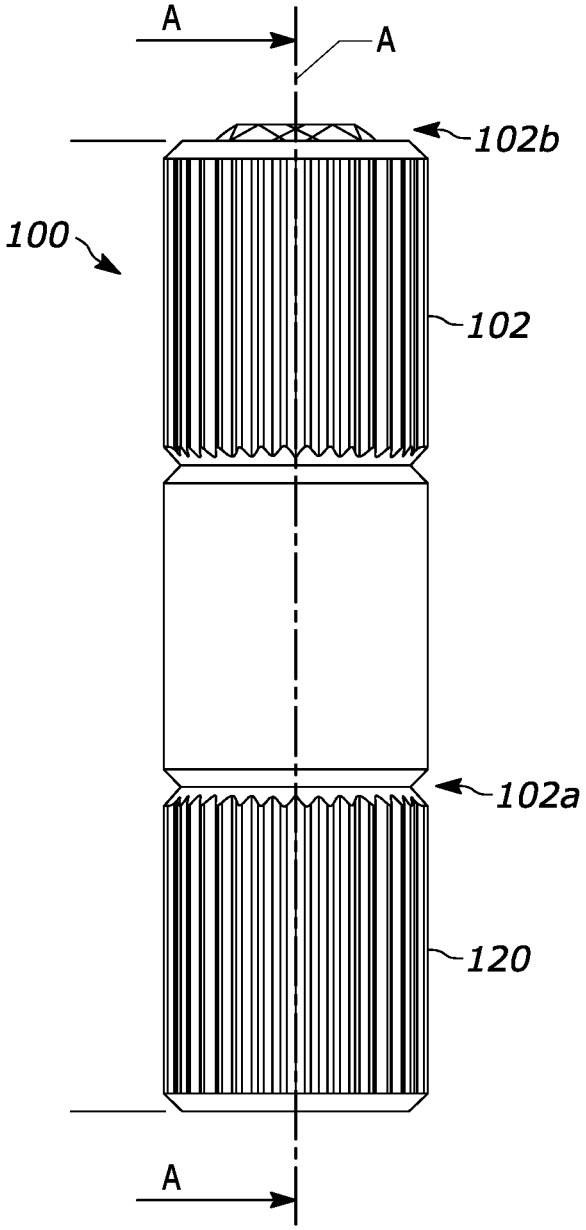
FIG. 1 illustrates a front elevation view of an example product container having an example closure mechanism in accordance with various examples.
Figure 2:
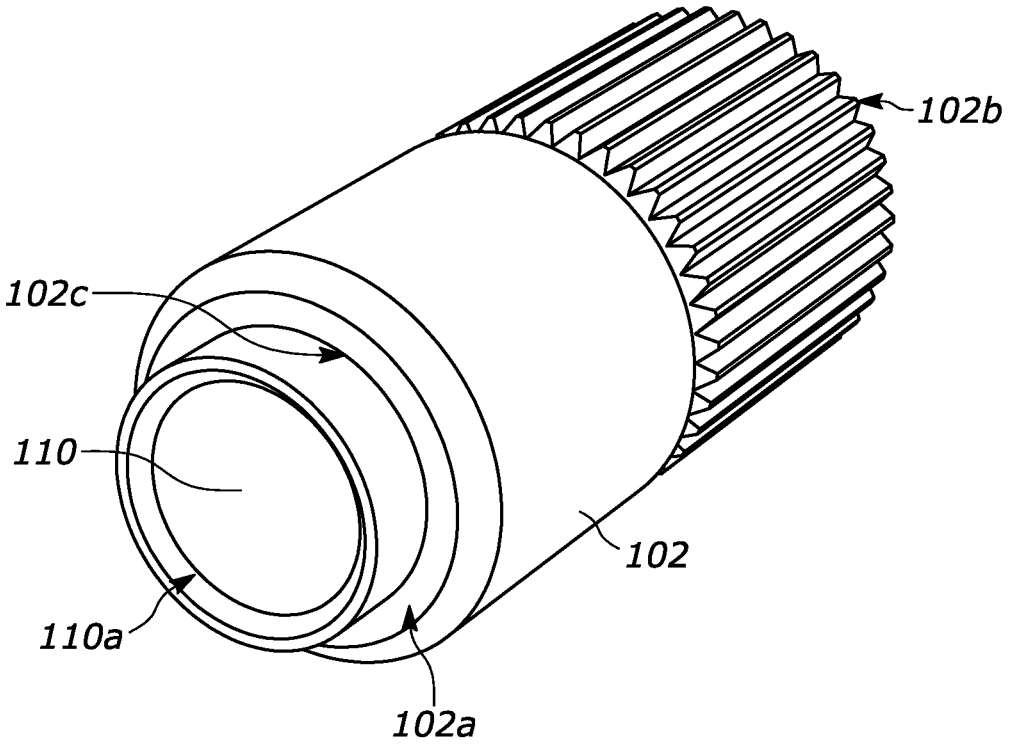
FIG. 2 illustrates a perspective view of an example cap of the example product container of FIG. 1 in accordance with various examples.
Figure 3:
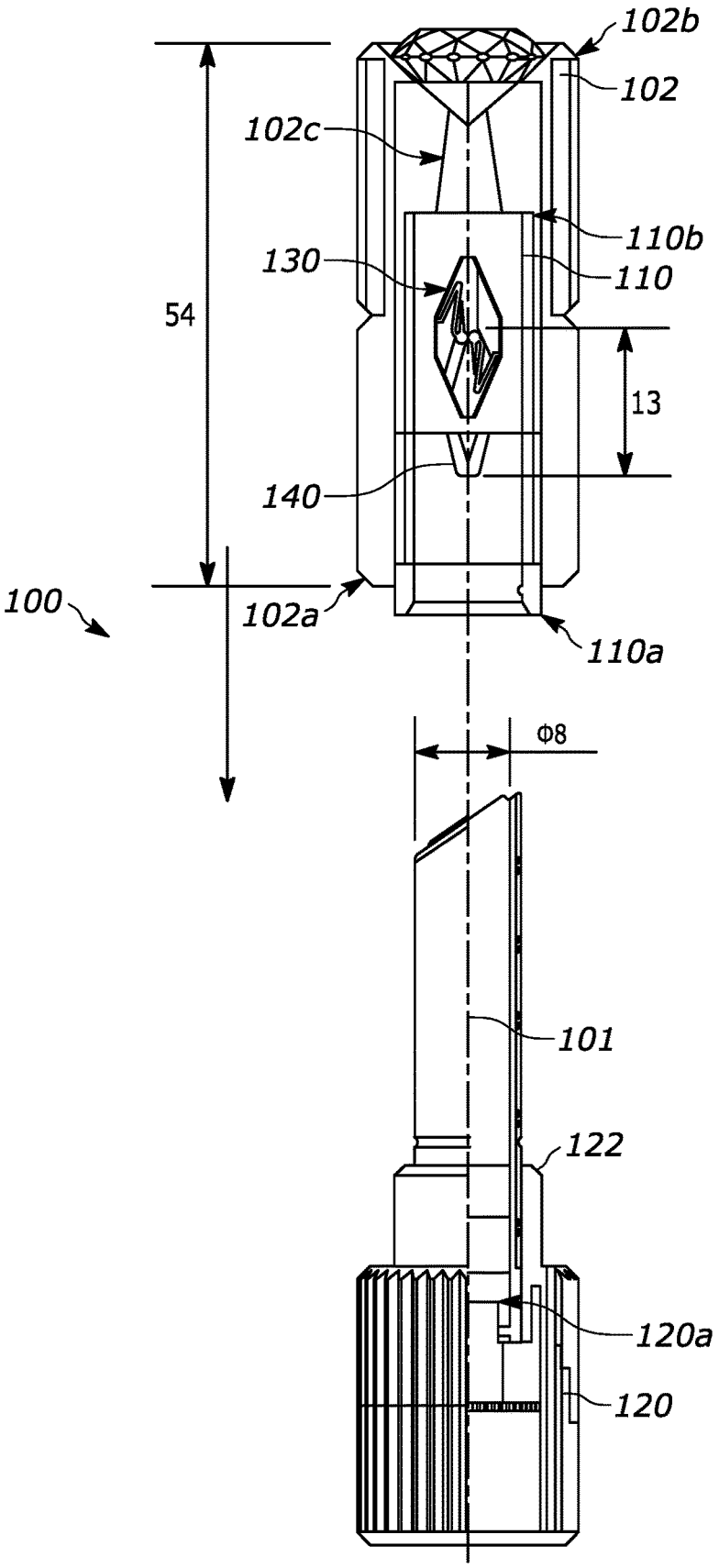
FIG. 3 illustrates a partial cut-out front elevation view of the example product container of FIGS. 1 & 2 in accordance with various examples.
Figure 4:
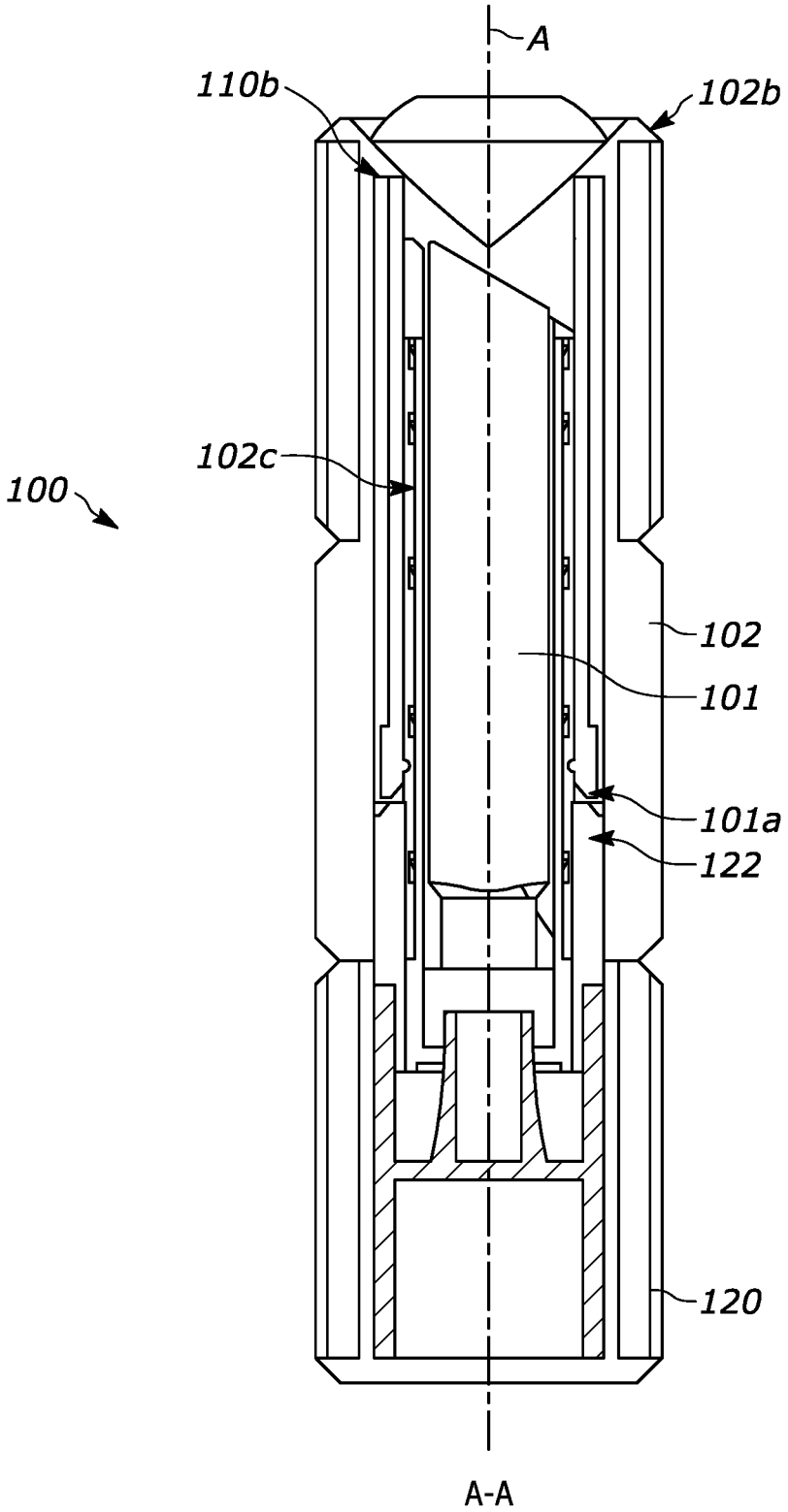
FIG. 4 illustrates a cross-sectional view of the example product container of FIGS. 1-3 taken at line A-A in accordance with various examples.
Figure 5:
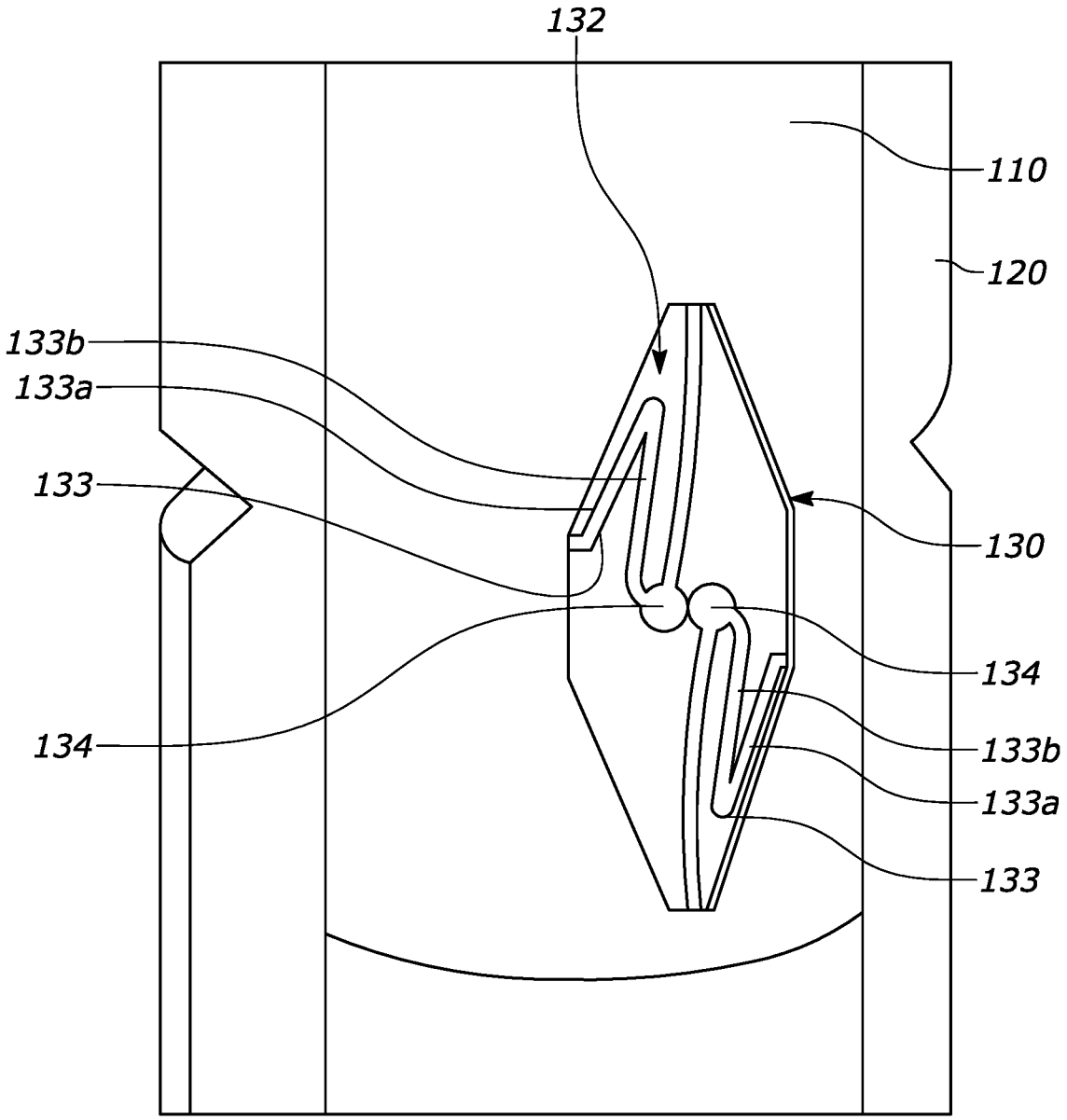
FIG. 5 illustrates a partial cut-out perspective view of the example closure mechanism of FIGS. 1-4 in accordance with various examples.
Figure 6:
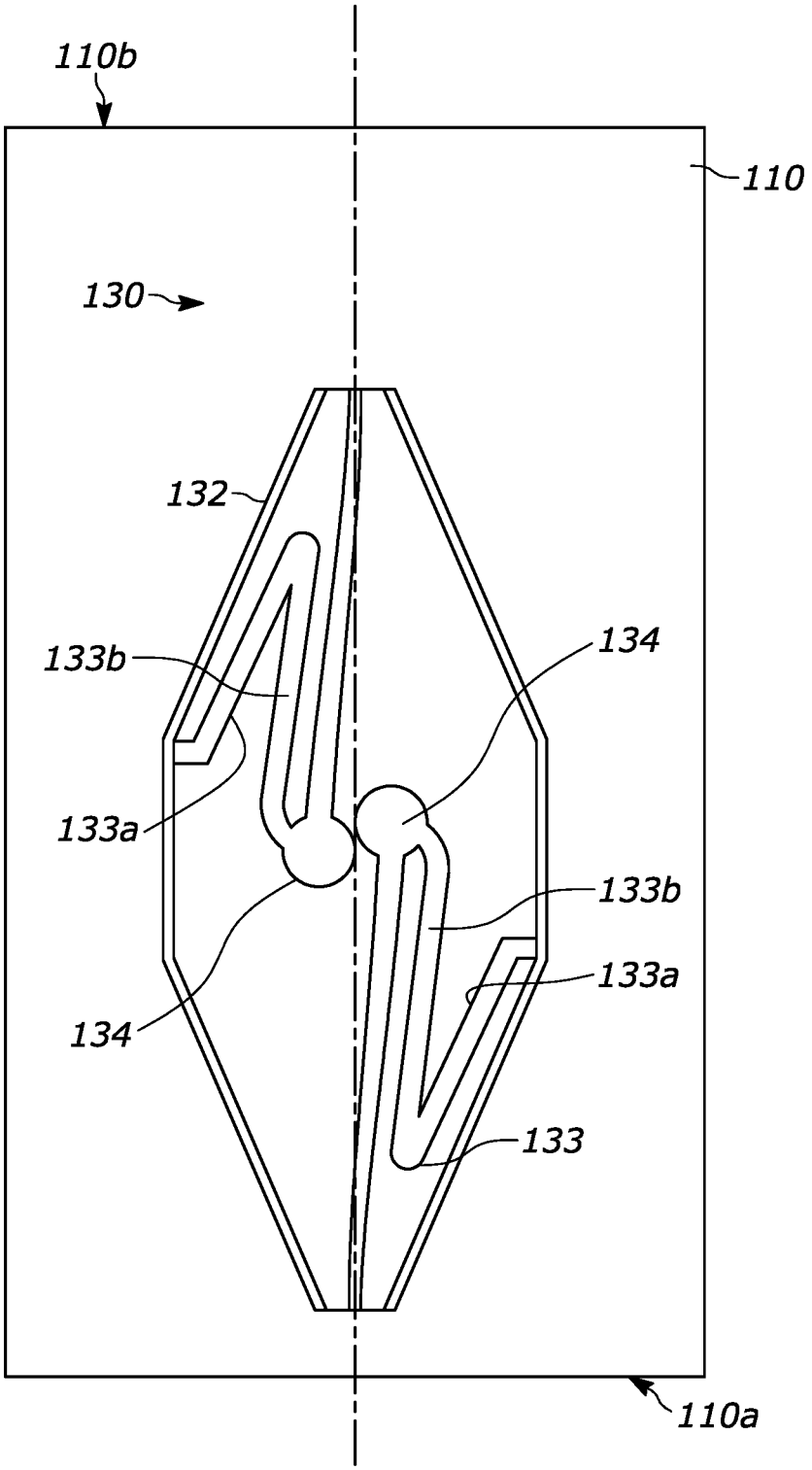
FIG. 6 illustrates a side elevation view of a portion of the example closure mechanism of FIGS. 1-5 in accordance with various examples.
Figure 7:
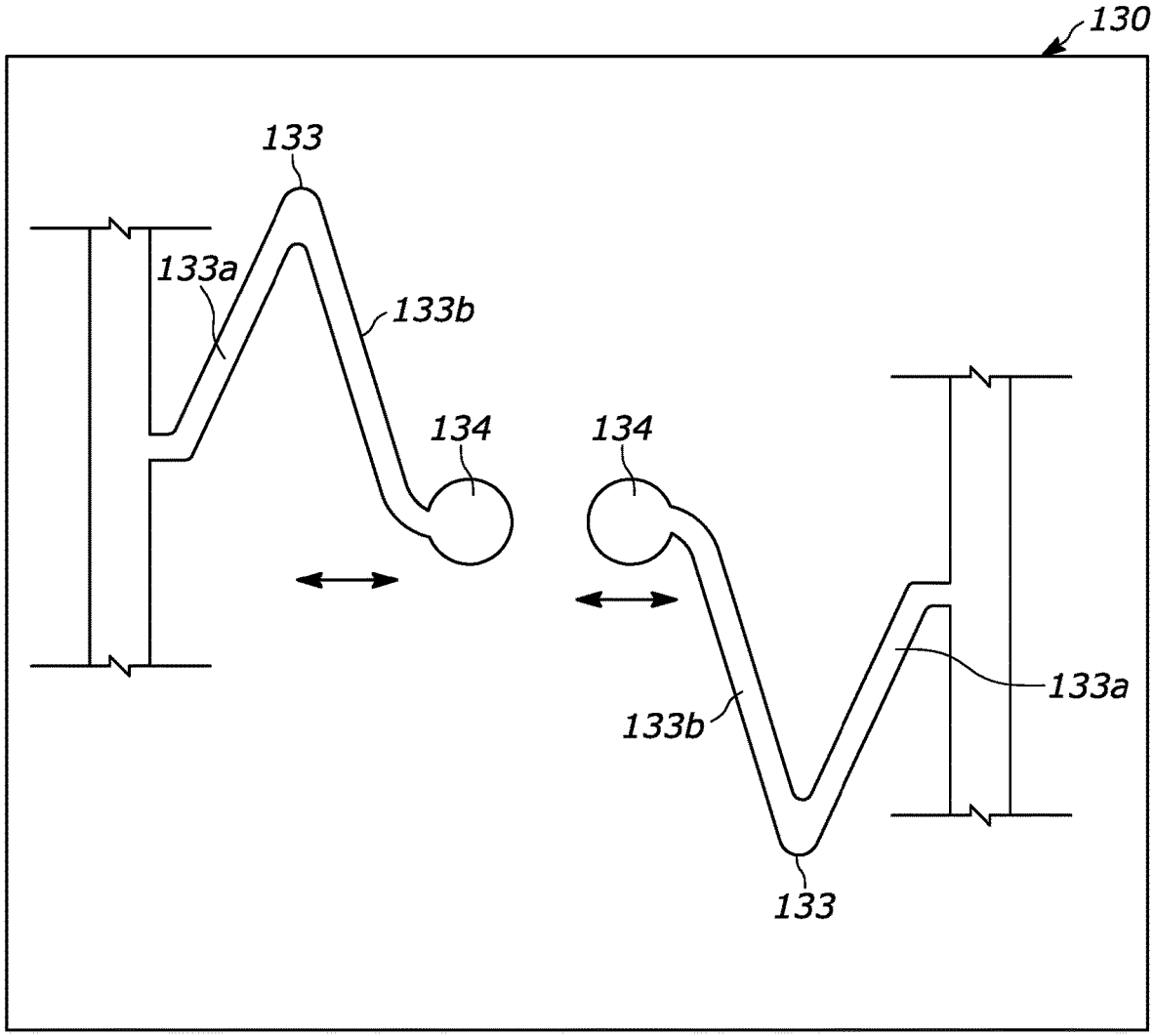
FIG. 7 illustrates a side elevation view of the portion of the example closure mechanism of FIG. 6 in accordance with various examples.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible examples are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various approaches, closure systems for cosmetic, hair care, body care, skincare, and/or other products are provided that allow the reliable coupling of the distinct components of the container in a secure manner. Such closure systems are provided that do not include magnets or magnetic materials, therefore reducing packaging and manufacturing costs, as well as providing for a more environmentally friendly container that may be recycled or otherwise disposed of in a sustainable manner.

Turning to the Figures, a container 100 is provided for containing and dispensing a cosmetic substance 101. As previously noted, the cosmetic substance 101 may be in the form of a cosmetic, a hair care, a body care, a skincare, and/or any other similar product. While the illustrated examples depict the cosmetic substance 101 in the form of a lipstick or lip gloss product, any number of alternative examples are possible.

The container 100 includes a cap body 102, a cap liner 110, a base 120, and a closure mechanism 130. The cap body 102 (which, in some examples may be considered a first body) includes a first end 102*a*, a second end 102*b*, and a cap cavity 102*c*. In some examples, the cap cavity 102*c* receives at least a portion of the cosmetic substance 101 therein when the cap body 102 is coupled with the base 120. The cap body 102 extends along a longitudinal axis "A." The cap liner 110 (which, in some examples may be considered a second body) is at least partially disposed within the cap cavity 102*c* and includes a first end 110*a* and a second end 110*b*. The cap liner 110 is at least partially hollow, and as such, may also receive at least a portion of the cosmetic substance 101 therein. The cap liner 110 may be movably coupled with the cap body 102 to allow relative movement therebetween in a direction along the longitudinal axis A. The cap body 102 and the cap liner 110 may be movably coupled with each other via any number of suitable approaches such as, for example, via a channel-protrusion arrangement, a sliding arrangement, a telescoping arrangement, and the like. Other examples are possible. It is to be appreciated that while the illustrated cap body 102 includes a number of external features and/or components, in some examples, the cap body 102 (as well as the other components of the container 100) may have fewer or no external features as desired.

Figure 9:
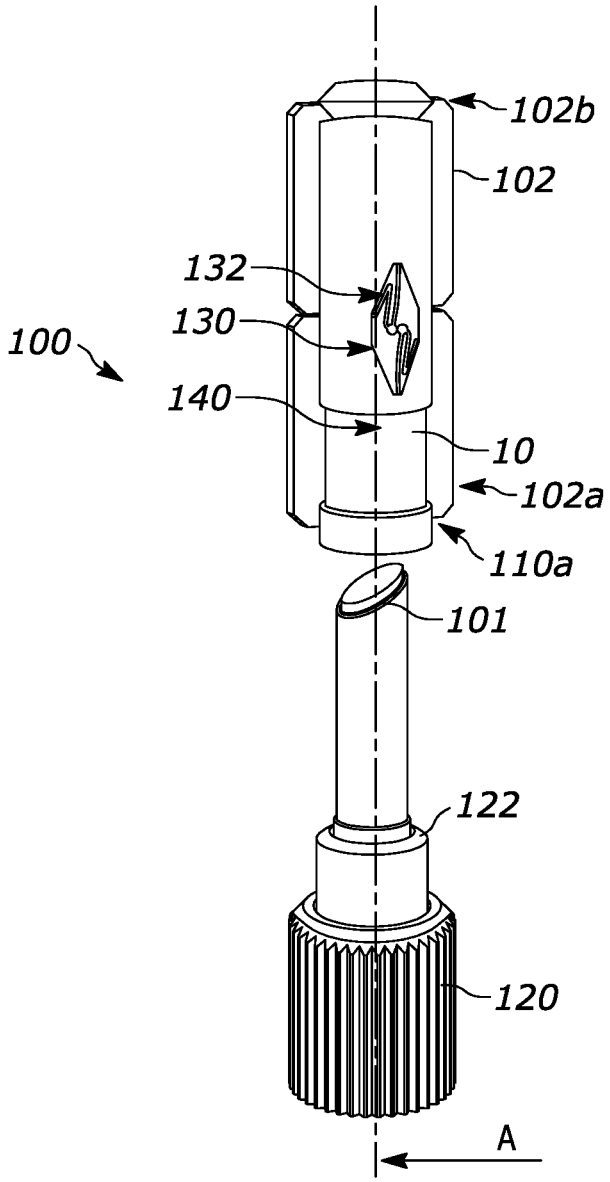
FIG. 9 illustrates a partial cut-out perspective view of the example product container of FIGS. 1-8 prior to coupling in accordance with various examples.
Figure 10:
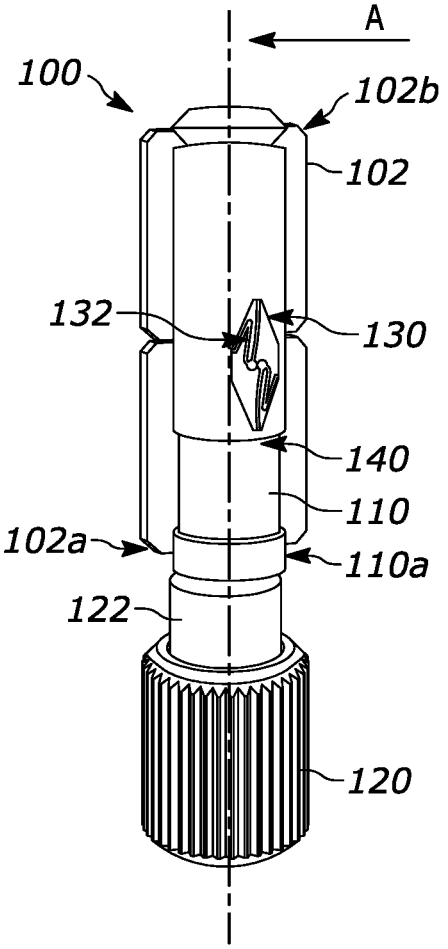
FIG. 10 illustrates a partial cut-out perspective view of the example product container of FIGS. 1-9 during coupling in accordance with various examples.
Figure 11:
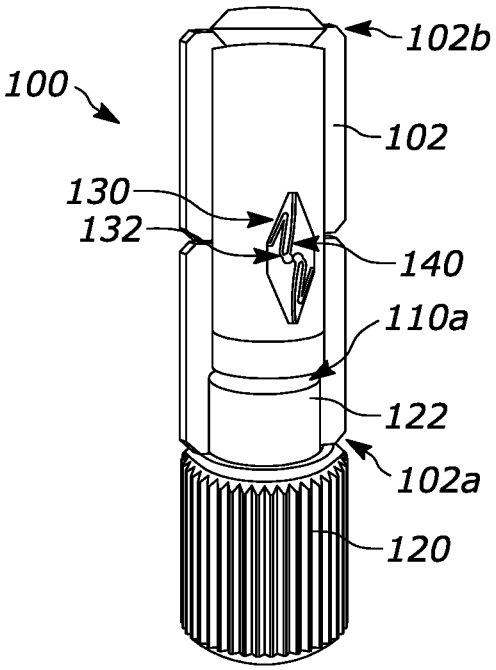
FIG. 11 illustrates a partial cut-out perspective view of the example product container of FIGS. 1-10 after coupling in accordance with various examples.

As illustrated in FIGS. 2, 3, 9, and 10, in some examples, the first end 110*a* of the cap liner 110 may be configured to protrude outwardly beyond the first end 102*a* of the cap body 102 in a first position, and as illustrated in FIG. 11, the first end 110*a* of the cap liner 110 may be disposed within the cap cavity 102*c* in a second position. It is to be appreciated that while the cap body 102, the cap liner 110, and other components are illustrated as being generally cylindrical in form, such components may take any number of desired shapes and/or configurations such as, for example, rectangular cuboid, cuboid, and/or other prismatic or similar shapes.

The base 120 includes a cavity 120*a* adapted to receive and/or retain the cosmetic substance 101. It is to be appreciated that in some examples, the base 120 may alternatively be considered the second body. The cosmetic substance 101 may be operably coupled with and/or retained by the base 120 using any number of suitable approaches. The base 120 further includes a neck 122 extending therefrom. In some examples, the neck 122 is in the form of a stepped platform forming any number of ledges or ridges. Other arrangements of the neck are possible such as, for example, a sloped and/or tapered arrangement.

The closure mechanism 130 is provided to generate relative movement between the first and second bodies, which, in the illustrated examples, are the cap body 102 and the cap liner 110. As previously noted, in some alternative examples, this relative movement may be between the cap body 102 and the base 120. Generally speaking, the closure mechanism 130 includes a resilient member 132 and a coupling protrusion 140 that interact with each other to generate the relative movement between the cap body 102 and the cap liner 110. More specifically, in some examples, the resilient member 132 may be coupled with the cap body 102 or the cap liner 110, while the coupling protrusion 140 is coupled with the other of the cap liner 110 or the cap body 102. Such relative coupling may occur via any number of suitable approaches such as, for example, via the use of adhesives applied to a desired surface of the cap body 102 and/or the cap liner 110 or by integrally forming a portion or portions of the resilient member 132 and/or the coupling protrusion 140 with the cap body 102 and/or the cap liner 110. Other examples are possible.

With reference to FIGS. 4-7, the illustrated resilient member 132 is in the form of a spring having any number of arms 133. In the illustrated example, each arm 133 includes a first portion 133*a* and a second portion 133*b* that are angled or otherwise bent relative to each other. In some examples, the first and second portions 133*a*, 133*b* are formed from a single elongated material and are bent at a point therebetween. Each of the arms 133 of the resilient member 132 may be constructed from a resilient or flexible material that may selectively move between a resting (i.e., a de-energized) position and a compressed (i.e., an energized) position. For example, the arm or arms 133 may be constructed from a metallic material, a polymer, and/or any other suitable material. In the illustrated examples, the first portion 133*a* of the arm 133 is mounted to or otherwise coupled with a fixed portion. Further, in some examples, each of the arms 133 is arranged in a mirrored and inversed position whereby the first portion 133*a* of one arm 133 is angled in the opposite direction as the first portion 133*a* of the other arm 133. Such an arrangement may provide relatively even force distribution to create a smoother sliding engagement with the coupling protrusion 140. Any number of alternative arrangements are possible.

A finger 134 is positioned at an end of the second portion 133*b* of each arm 133. Generally speaking, the finger 134 may be in the form of a knob or a nodule and is adapted to slidably engage the coupling protrusion 140 to compress or energize each arm 133. It is to be appreciated that the resilient member 132 may include any number of arms having any number of portions and/or fingers as desired. Further, it is to be appreciated that any number of resilient members 132 may be provided and coupled with the components of the container 100.

Figure 8:
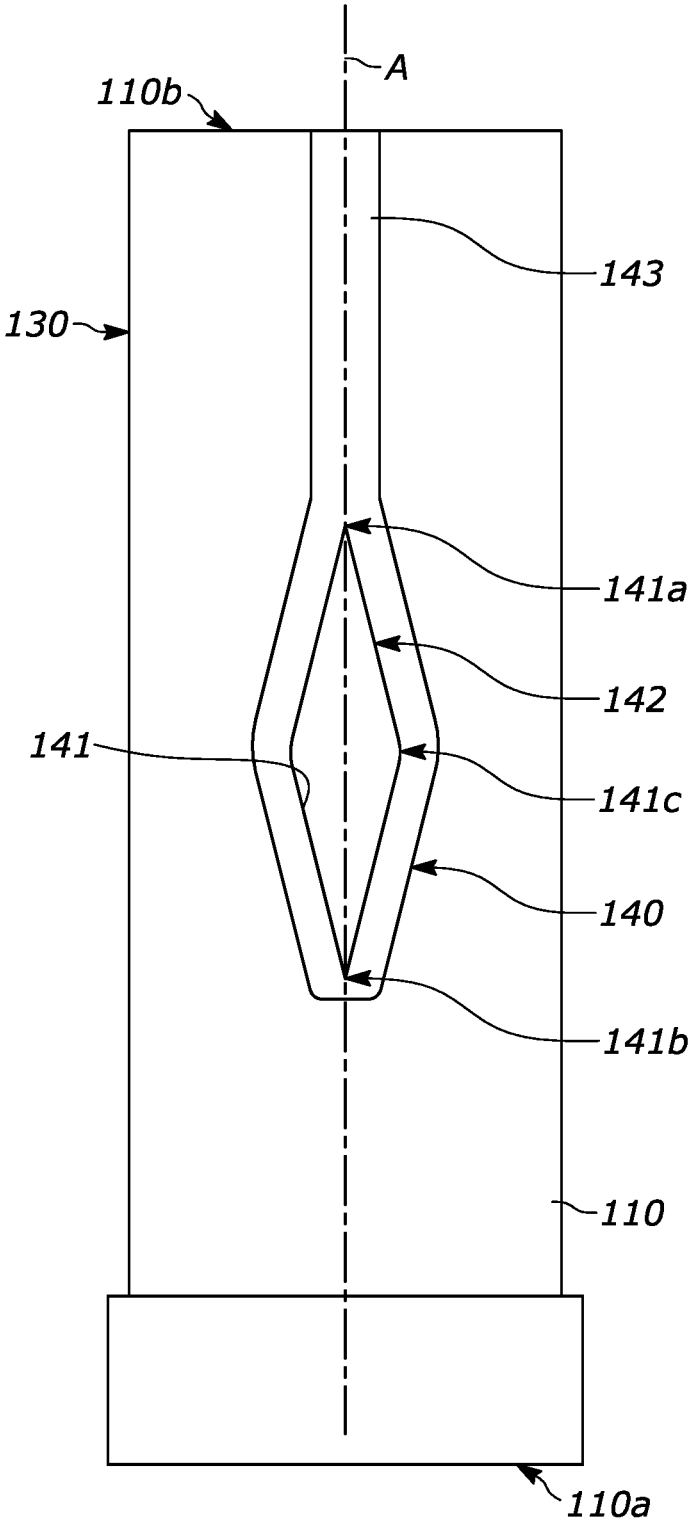
FIG. 8 illustrates a side elevation view of a portion of the example closure mechanism of FIGS. 1-7 in accordance with various examples.

With reference to FIG. 8, the coupling protrusion 140 includes a tapered portion 141 having an engagement surface 142. In the illustrated example, the tapered portion 141 forms a generally diamond or rhomboid shape in which first and second ends 141*a*, 141*b* have a smaller dimension than a middle region 141*c*. The tapered portion 141 may extend inwardly into or outwardly from a surface (e.g., an inner or outer surface of the cap liner 110 or an inner surface of the cap body 102), and as such, defines the engagement surface 142 that the finger 134 of the resilient member 132 may slidably engage. In some examples and as illustrated in FIG. 8, the coupling protrusion 140 may also include a track 143 extending around the engagement surface 142 as well as a length near the first end 141*a* of the tapered portion 141. Such a track 143 may be formed by an additional wall, depression, and/or protrusion. Other examples are possible.

In some examples, the finger 134 of each arm 133 may be disposed within the track 143. Because the resilient member 132 and the coupling protrusion 140 are coupled or formed with the cap body 102 or the cap liner 110 (or, in some examples, with the base 120), the resilient member 132 and the coupling protrusion 140 cause relative movement between the cap body 102 and the cap liner 110 (or, in some examples, the base 120). More specifically, with reference to FIGS. 3 and 9, in a first configuration (e.g., one where the cap body 102 is decoupled from the base 120), the arm or arms 133 may be in an initial position. In some examples, the arms may be in a de-energized state in this initial position. Upon moving the cap body 102 relative to the cap liner 110, the finger 133 slides along the track 143 (in examples where the track 143 is present) until engaging the first end 141*a* of the tapered portion 141 of the coupling protrusion 140.

Continued urging of the cap body 102 relative to the cap liner 110 causes the finger or fingers 134 to move outwardly along the engagement surface 142 (i.e., in a different, non-parallel direction relative to the longitudinal axis A), thus compressing each arm 133. When the finger or fingers 134 travel to the middle region 141*c* of the tapered portion 141, the arm or arms 133 are in a second, energized position. Upon urging the cap body 102 relative to the cap liner 110 beyond an apex location in which the finger or fingers 134 traverse the middle region 141*c*, the arm or arms 133 are "released" and cause the finger or fingers 134 compress and slide against the engagement surface 142. The stored energy in the arm or arms 133 causes the finger 134 to traverse the tapered portion 141 further in the first direction (along the longitudinal axis A) without requiring user input. Ultimately, the finger or fingers 134 will travel to the second end 141*b* of the tapered portion 141 where the arm or arms 133 are in a de-energized position (or relatively less-energized as compared with the energized position).

Because one of the resilient member 132 or the coupling protrusion 140 is coupled with one of the first or second bodies (i.e., the cap body 102 and the cap liner 110 or the base 120) and the other of the coupling protrusion 140 or the resilient member 132 is coupled with the other of the second or first bodies, when the resilient member 132 engages the coupling protrusion 140, relative movement therebetween causes relative movement between the first and second bodies. More specifically, as illustrated in FIGS. 9-11, the first body is in the form of the cap body 102 and the second body is in the form of the cap liner 110. As illustrated in FIG. 9, in some examples, in this initial position where the cap body 102 is not coupled with the base 120, the first end 110*a* of the cap liner 110 protrudes outwardly from the first end 102*a* of the cap body 102. However, in other examples (not illustrated), the first end 110*a* of the cap liner 110 may not protrude outwardly from the first end 102*a* of the cap body 102 to provide for an uninterrupted and visually simplistic design. In either of these examples, in this position, the finger or fingers 134 of the resilient member 132 are disposed within the track 143 of the coupling protrusion 140 and/or near the first end 141*a* of the tapered portion 141. In this initial position, there is little or no relative movement between the cap body 102 and the cap liner 110 due to the arm or arms 133 being in an initial position that requires sufficient force to overcome the resting spring force of each arm 133.

With reference to FIG. 10, when a user wishes to close the container 100, they may place the cap body 102 and the cap liner 110 onto the base 120 by moving the cap body 102 and the cap liner 110 in a first direction (i.e., a direction towards the base 120). In the illustrated example, the cosmetic product 101 may then be at least partially disposed within the cap cavity 102*c*. Generally, this relative coupling movement in the first direction occurs along the longitudinal axis A. Eventually, the first end 110*a* of the cap liner 110 will abut or otherwise contact the neck 122 of the base 120. Such contact prevents the cap liner 110 from moving further in the first direction.

If a user continues to urge the cap body 102 in the first direction, relative movement between the cap body 102 and the cap liner 110 commences. This relative movement causes the finger or fingers 134 of the resilient member 132 to move along the track 143 and slidably engage the engagement surface 142 of the tapered portion 141. As previously noted, while the finger or fingers 134 travel from the first end 141*a* to the middle region 141*c*, the arms 133 move in a second, orthogonal or non-parallel direction relative to the longitudinal axis A to an energized position where they become energized (e.g., by compressing the first and second portions 133*a*, 133*b*).

With reference to FIG. 11, when a user urges the cap body 102 to a point where the finger or fingers 134 pass the middle region 142*c* of the tapered portion 141, the stored energy within the arm or arms 133 becomes released such that the finger or fingers 134 advance towards the second end 141*b* of the tapered portion 141. This advancement causes the cap body 102 to be drawn closer to or otherwise advance in the first direction towards the base 120 until the first end 102*a* thereof abuts and/or otherwise contacts or engages a portion of the base 120. This engagement or contact between the cap body 102 and the base 120 stops the cap body 120 from moving further in the first direction. In some examples, the arm or arms 133 may be in a fully de-energized position upon such engagement. In other examples, the arm or arms 133 may still be partially energized upon such engagement. In either of these examples, the arm or arms 133 may provide resistance from removing the cap 102 from the base 120 as a way to ensure the components stay coupled together and that the container remains in a closed configuration.

As previously noted, in some examples, the arm or arms 133 of the resilient members 132 move in a direction that is orthogonal or otherwise non-parallel to the direction of relative motion between the cap body 102 and the cap liner 110 (i.e., along the longitudinal axis A). So arranged, the closure mechanism 130 converts the relative sliding movement between the resilient member 132 and the coupling protrusion 140 into a different direction, and as such may allow for a compact closure mechanism design.

To remove the cap body 102 and the cap liner 110 from the base 120, a user may pull on the cap body 102 in a third direction (i.e., a direction opposite from the first direction). Such pulling will cause the arm or arms 133 to slidably engage the engagement surface 142 and move from the second end 141*b* of the tapered portion 141 to the middle region 141*c* thereof. As before, at this time, the arm or arms 133 will be energized in this position. It is to be appreciated that if the user releases the cap body 102 before the arm or arms 133 pass the middle region 141*c* of the tapered portion 141, the arm or arms 133 will cause the cap body 102 to move back in the first direction to "close" the container 100. However, if the user urges the cap body 102 to the point where the finger or fingers 134 pass the middle region 141*c* of the tapered portion 141, the arm or arms 133 are released and exert a force that causes the cap body 102 to continue moving in the third direction until the cap body 102 extends upwardly from the cap liner 110 as illustrated in FIG. 10. A user may then pull the cap body 102 and the cap liner 110 from the base 120 to apply the cosmetic product 101.

It is to be appreciated that while the previous example described relative movement between the cap body 102, the cap liner 110, and the base 120, in some examples (not illustrated), the container 100 may not include a cap liner 110 or the cap liner 110 may not move relative to the cap body 102. In such examples, the base 120 may be operably coupled with one of the resilient member 132 or the coupling protrusion 140, and the cap body 102 or the cap liner 110 (if present) may be operably coupled with the other of the coupling protrusion 140 or the resilient member 132. Accordingly, the cap body 102 and the base 120 still move relative to each other to cause the finger or fingers 134 to travel along the engagement surface of the tapered portion 141.

Figure 12:
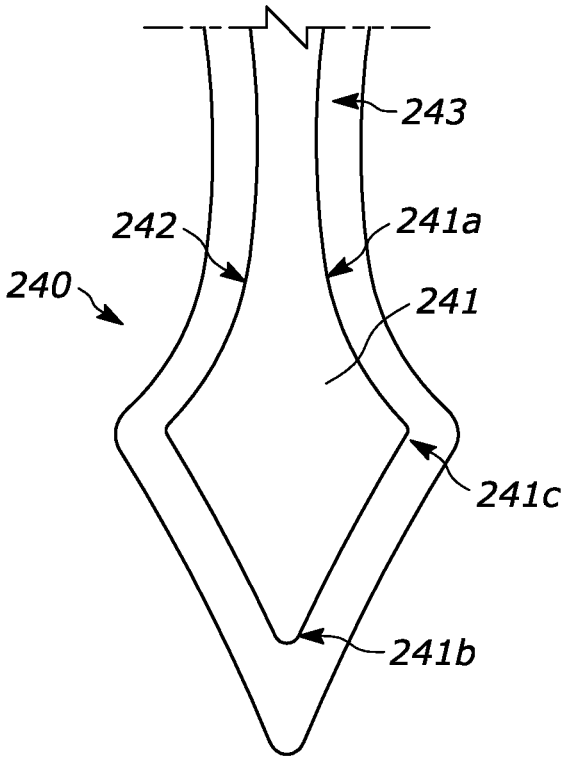
FIG. 12 illustrates a side elevation view of a first alternative example coupling protrusion of an example closure mechanism for use with the example product container of FIGS. 1-11 in accordance with various examples.
Figure 13:
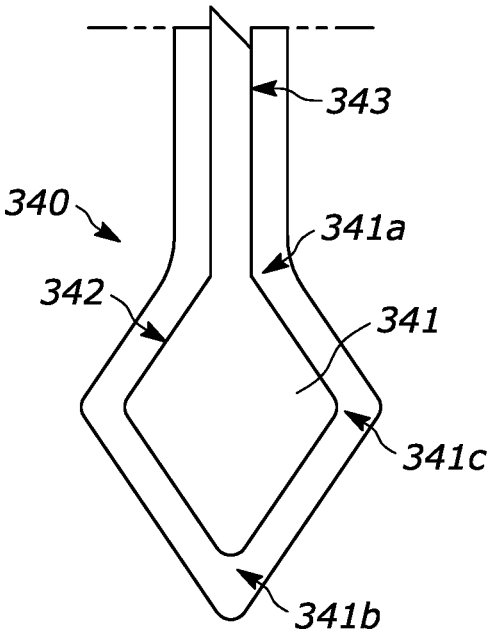
FIG. 13 illustrates a side elevation view of a second alternative example coupling protrusion of an example closure mechanism for use with the example product container of FIGS. 1-11 in accordance with various examples
Figure 14:
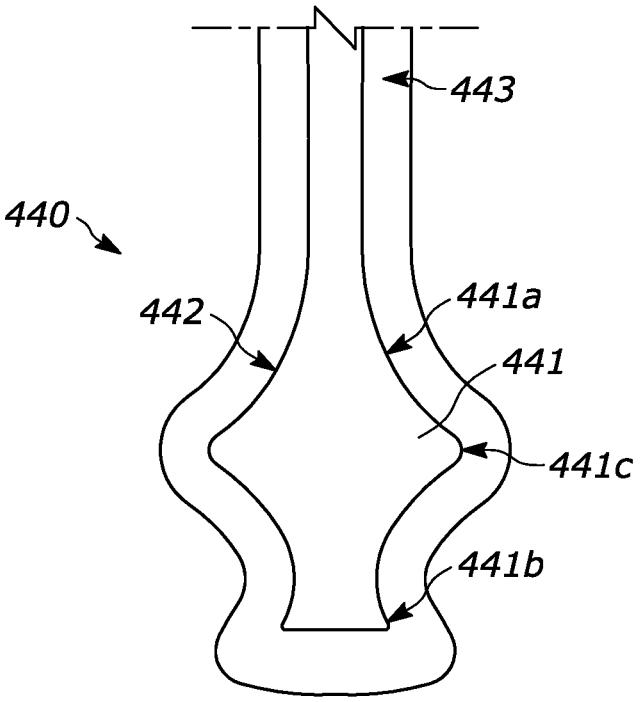
FIG. 14 illustrates a side elevation view of a third alternative example coupling protrusion of an example closure mechanism for use with the example product container of FIGS. 1-11 in accordance with various examples.

It is also to be appreciated that the coupling protrusion 140 may be provided in any number of varying shapes and/or configurations. As non-limiting alternative examples, FIGS. 12-14 illustrate alternative coupling protrusions 240, 340, 440 that may be incorporated into the coupling mechanism 130. These coupling protrusions 240, 340, 440 include similar features as the coupling protrusion 140, and as such, are provided with reference numerals having identical two-digit suffixes. For the sake of brevity, such components will not be described in further detail. The speed and/or smoothness of the closure mechanism 130 may be modified by providing coupling protrusions having varying shapes, sizes, or other configurations.

Figure 15:
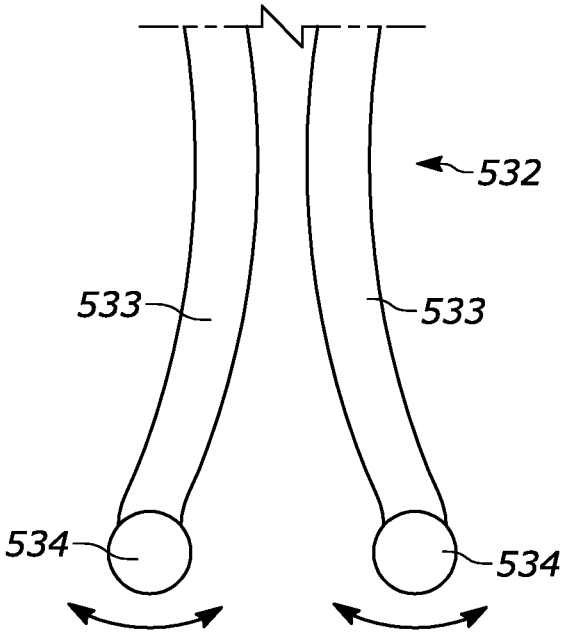
FIG. 15 illustrates a side elevation view of an alternative example resilient member of an example closure mechanism for use with the example product container of FIGS. 1-11 in accordance with various examples

It is also to be appreciated that the resilient member 132 may be provided in any number of varying shapes and/or configurations. As a non-limiting alternative example, FIG. 15 illustrates an alternative resilient member 532 that may be incorporated into the coupling mechanism 130. This resilient member 532 may include similar features as the resilient member 132, and as such, is provided with reference numerals having identical two-digit suffixes. For the sake of brevity, such components will not be described in further detail. In this example, the resilient member 532 includes any number of arms 533 extending in a generally linear direction. The speed and/or smoothness of the closure mechanism may be modified by providing resilient members varying shapes, number of arms, and different spring constants.

Figure 16:
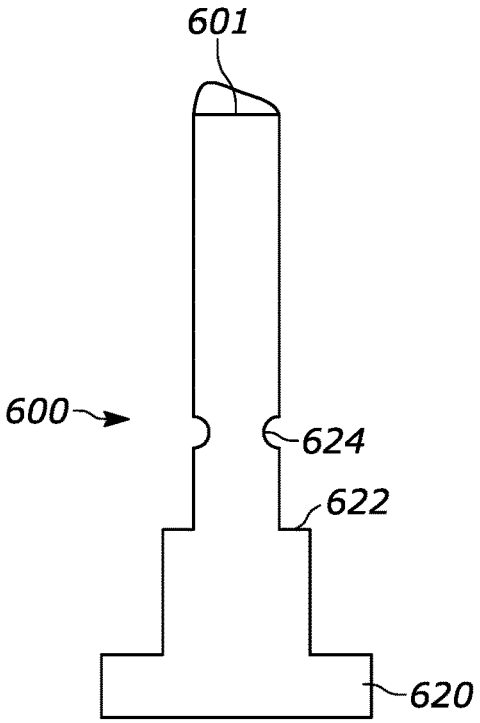
FIG. 16 illustrates a side elevation view of an example base portion of an alternative product container in accordance with various examples
Figure 17:
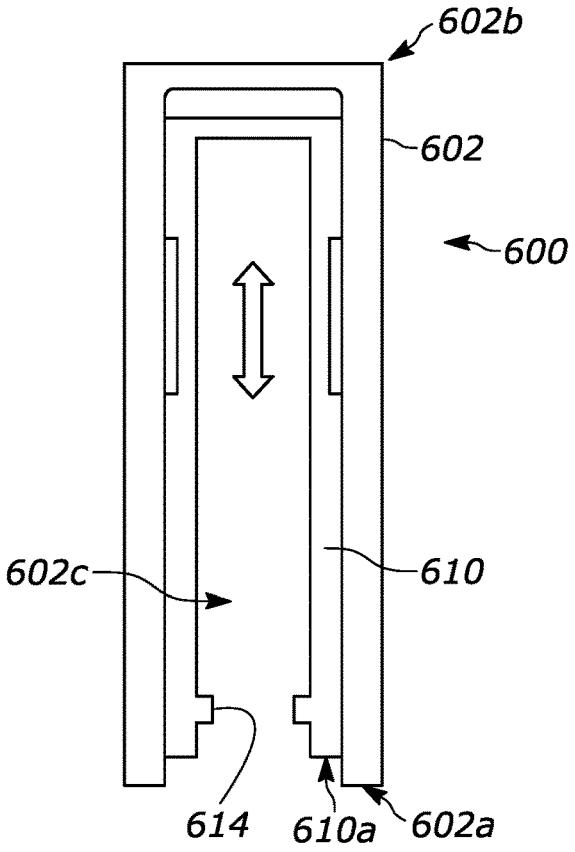
FIG. 17 illustrates a side elevation view of an example cap portion of the alternative product container of FIG. 16 in accordance with various examples.
Figure 18:
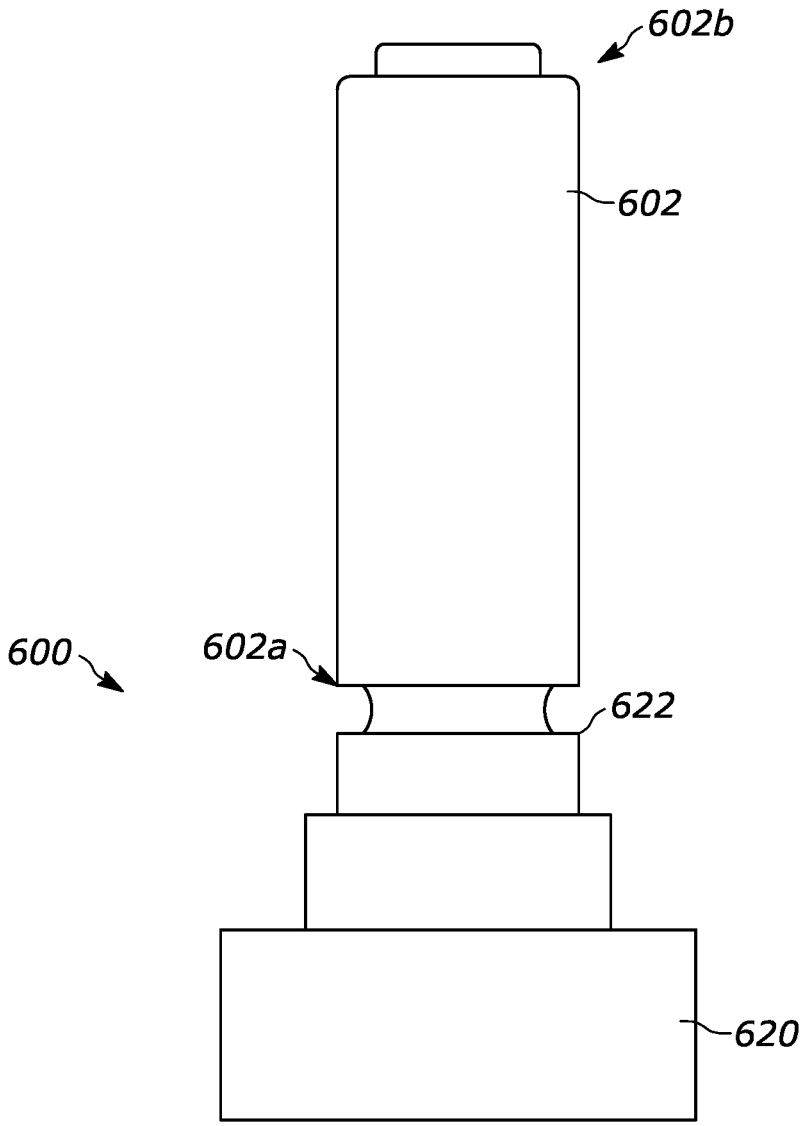
FIG. 18 illustrates a side elevation view of the example alternative product container of FIGS. 16 & 17 during coupling in accordance with various examples.

With reference to FIGS. 16-18, an alternative container 600 is provided having many of the features described with respect to FIGS. 1-15. Accordingly, the container 600 is provided with reference numerals having identical two-digit suffixes as those used in FIGS. 1-15. For the sake of brevity, such components will not be described in substantial detail. However, in this example, the base 620 includes a retention mechanism 624 in the form of a notch or channel that may engage a corresponding retention mechanism 614 on the cap liner 610 in the form of a protrusion. Such components may engage each other to provide an additional retention force to ensure the cap body 602 does not unintentionally decouple from the base 620.

In some alternative arrangements (not illustrated), the coupling protrusion or the resilient member may be angled to generate a twisting motion upon the closure mechanism becoming engaged. Further, in some alternative examples, each side of the coupling protrusion may be asymmetrical relative to the longitudinal axis. Such modifications may provide for any number of desired closure movements.

In some examples (not illustrated), the cap body and the cap liner may be encased within an additional outer cap. This outer cap may be provided to prevent a user from observing the relative movements between components when in use.

So arranged, the mechanisms described herein may provide a smooth and customizable closure to sure a container in a closed configuration. Such a system may result in significant reductions in packaging waste due to the recyclability of the container, and may also reduce manufacturing costs. The containers described herein lack potential product contaminants, and as such, may be used with any number of varying cosmetic products, hair care products, body care products, skincare products, fragrance products, and the like. The closure mechanisms described herein may be modified to accommodate packaging having any desired shape, size, and or configuration, and such containers may incorporate any number of desired closure mechanisms therein.

It is to be appreciated that while the example cosmetic products and cosmetic product containers illustrated in the figures are in the form of lipstick or lip gloss products, the approaches described herein may be suitable for any number of containers including cosmetic product containers, hair care product containers, body care product containers, skincare product containers, fragrance containers, and the like. Other examples are possible.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment. Thus, the following claims are hereby incorporated into the Detailed Description, with each claim standing on its own as a separately claimed subject matter.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A container including:

a first body having a resilient member operably coupled thereto or formed therewith, the first body extending along a longitudinal axis and;

a second body having a coupling protrusion operably coupled thereto or formed therewith, the coupling protrusion having a first end, a second end, and a middle region between the first end and the second end, the first end and the second end of the coupling protrusion each having a smaller dimension than the middle region thereof, the coupling protrusion further including an engagement surface and a track extending around the engagement surface, the second body adapted to move in a first direction to operably couple with the first body of the first portion;

wherein upon operably coupling the first body with the second body, the resilient member is adapted to engage the coupling protrusion and move in a second direction, the second direction being different than the first direction.

2. The container of claim 1, wherein the second direction is a non-parallel direction relative to the longitudinal axis of the first body.

3. The container of claim 1, wherein the resilient member includes a plurality of arms.

4. The container of claim 1, wherein one of the first body or the second body includes a container cap, and the other of the first body or the second body includes a container base.

5. The container of claim 1, wherein one of the first body or the second body includes a container cap, and the other of the first body or the second body includes a container cap liner.

6. A cosmetic product container comprising:

a cap body having a first end and a second end and defining a cap cavity;

a second body operably coupled with the cap body and being adapted to operably couple therewith;

a resilient member operably coupled with one of the cap body or the second body, the resilient member having a first portion, a second portion being angled acutely relative to the first portion, and a finger positioned at an end of the second portion, the resilient member being movable between an initial position, an energized position, and a de-energized position; and a coupling protrusion operably coupled with the other of the cap body or the second body, the coupling protrusion adapted to slidably engage the finger of the resilient member;

wherein upon operably coupling the cap body with the second body, the coupling protrusion urges the resilient member from the initial position to the energized position, wherein continued relative movement between the cap body and the second body causes the resilient member to move to the de-energized position whereby the cap body is secured with the second body.

7. The cosmetic product container of claim 6, wherein the coupling protrusion includes a tapered body having an engagement surface and the resilient member includes a finger adapted to slidably engage the engagement surface of the tapered body.

8. The cosmetic product container of claim 7, wherein the resilient member includes a plurality of arms.

9. The cosmetic product container of claim 6, wherein the second body includes a container liner or a container base.

* * * * *